United States Patent [19]

Ono et al.

[11] 4,209,670

[45] Jun. 24, 1980

[54] MOVING-COIL TYPE PICKUP CARTRIDGE

[75] Inventors: Tsuyoshi Ono, Yamato; Norio Shibata, Sagamihara; Katsuhiko Oguri, Fujisawa; Masayoshi Uchida, Yokohama; Kazuhiro Sato, Sagamihara; Hidetoshi Sato, Yamato, all of Japan

[73] Assignee: Victor Company of Japan, Ltd., Yokohama, Japan

[21] Appl. No.: 953,777

[22] Filed: Oct. 23, 1978

[30] Foreign Application Priority Data

Oct. 24, 1977 [JP] Japan ..... 52-141857[U]
Oct. 24, 1977 [JP] Japan ..... 52-141858[U]

[51] Int. Cl.[2] ..... H04R 9/16
[52] U.S. Cl. ..... 179/100.41 D; 179/100.41 K
[58] Field of Search ..... 179/100.41 D, 100.41 K; 360/123; 274/37

[56] References Cited

U.S. PATENT DOCUMENTS

| | | | |
|---|---|---|---|
| 2,034,872 | 3/1936 | Keller | 179/100.41 D |
| 3,618,124 | 11/1971 | Dreisbach | 179/100.41 D |
| 3,648,264 | 3/1972 | Gruczelak | 360/123 |
| 3,679,843 | 7/1972 | Cho | 179/100.41 K |
| 4,124,783 | 11/1978 | Nemoto | 179/100.41 K |

FOREIGN PATENT DOCUMENTS

| | | | |
|---|---|---|---|
| 1135675 | 8/1962 | Fed. Rep. of Germany | 179/100.41 K |
| 939983 | 10/1963 | United Kingdom | 179/100.41 K |

*Primary Examiner*—Bernard Konick
*Assistant Examiner*—Alan Faber
*Attorney, Agent, or Firm*—Haseltine, Lake & Waters

[57] ABSTRACT

A moving-coil type pickup cartridge comprising a cantilever provided at the free end thereof with a stylus for tracing a sound groove of a record disc, a coil plate provided on the cantilever in a manner to vibrate in response to vibration of the stylus, and an arrangement for producing an effective magnetic field within a specific gap. The coil plate comprises a thin electrically insulating base plate and at least one coil which is formed from a thin film in a spirally-shaped pattern on at least one surface of the base plate. The coil plate has at least one upright part formed by bending the base plate together with a portion of the coil and interposed in a freely vibratory manner within said gap of the magnetic field producing arrangement and a mounting part integrally joined to the upright part and fixed to the cantilever.

6 Claims, 11 Drawing Figures

MOVING-COIL TYPE PICKUP CARTRIDGE

BACKGROUND OF THE INVENTION

The present invention relates generally to pickup cartridges of moving-coil type wherein a coil plate comprising an electrically insulating thin plate and coils of electroconductive film formed in spiral-shaped patterns on the thin plate is provided in a vibration system. More specifically, the invention relates to a moving-coil type pickup cartridge provided with a coil plate of a shape such that there is no influence due to leakage flux from the magnetic field producing section.

In general, among the moving-coil type stereo pickup cartridges known heretofore, there has been one having a vibration system of a construction wherein a square or cross-shaped core, around which a coil wire is wound, is fixed to the rear end of a cantilever. In another known pickup cartridge of this type, two armature links are provided on a cantilever and coils are provided by winding coil wire respectively around the ends of these links.

In each of these known pickup cartridges, however, the moving-coil assembly fixed to the cantilever, which comprises the coil winding and the core or the coil windings and the armature links, has a large mass. Therefore, the equivalent mass of the vibration system is large, whereby the characteristics particularly in the high-frequency range are poor, and signal pickup with good characteristics over a wide band cannot be achieved. If, in order to reduce the mass, the number of winding turns of the coils is decreased, the output will drop. Consequently, it has not been possible by means of moving-coil type pickup cartridge known heretofore to accomplish good signal pickup reproduction with high output, good signal to noise ratio, and, moreover, flat characteristics up to even a high-frequency range over a wide band.

Another difficulty encountered in the prior art has been that, since a magnetic material such as iron or permalloy has been used for the core or coil winding frame, the magnetostriction due to hysteresis and magnetic saturation is large. Still another difficulty has been that, since the coil assembly comprises coil wire wound around a winding frame, the thickness and volume of the coil structure are large. For this reason, the gap between the yoke and the pole piece in which the coil structure is interposed must be made large, whereby the magnetic conversion efficiency is poor. A further problem has been that the work of winding the coil wire around the winding frame has been laborious. Particularly in order to obtain a high value of the above mentioned magnetic conversion efficiency, it is necessary to reduce the thickness and volume of the coil structure thereby to decrease the above mentioned gap. For this purpose, a very fine wire (e.g., of a diameter of 10 microns) must be used for the coil wire, and this gives rise to difficulties in the coil winding work, risk of wire breakage, and lowering of work efficiency.

Furthermore, according to the concept of another known stereo pickup cartridge of moving-coil type, two coils formed by winding coil wire in the same plane in D-shape as a whole are mounted on a cantilever in a state wherein they are partly overlapping each other and in a position where they intersect the polar axis perpendicularly. In this pickup cartridge, however, since the mass of the coil is large, the equivalent mass of the vibration system is large, and particularly the characteristics at the higher frequencies are very poor, whereby the cartridge cannot be considered to be practicel. There is also a suggestion that these coils may be formed by printed circuits, but, with the above described coil arrangement, reduction to practice is difficult in any case. A pickup cartridge which embodies the above concept has not yet been reduced to practice and placed on the market.

Accordingly, the inventors have previously proposed a novel pickup cartridge of moving-coil type in which the above described difficulties have been overcome, and which has been reduced to practice. In this previously proposed pickup cartridge, a pair of coils are formed in the form of thin film and in a substantially hexagonal, vortex-shaped pattern on a thin glass substrate measuring, for example, 1 mm and 2 mm in length and breadth with a thickness of 50 μm. This coil plate, which is of very light weight, for example, of the order of 0.25 mg., is mounted on the cantilever of the pickup cartridge. In the forming of the above described coil patterns, a thin film of a metal material of high electroconductivity such as, for example, nickel is first formed on both surfaces of the thin insulative substrate by a process such as evaporation deposition in a vacuum. Then parts of the metal film thus deposited are removed by a process such as photo-etching to leave the metal film in the spirally wound pattern of the coils. To the casing of the pickup cartridge are fixed a pair of opposed yoke pieces having a gap therebetween in which the above mentioned coils are inserted and a permanent magnet for producing a magnetic field in the gap by way of these yokes. A feature of this pickup cartridge is that the mass of the coil plate is very small, whereby signal picking up can be carried out with good characteristics up to and through the higher frequencies.

In the above described previously proposed moving-coil type stereo pickup cartridge, a pair of yoke pieces form a magnetic field in a gap therebetween in which a coil plate is interposed. Each of the yoke pieces has two edge parts which are interconnected mutually at right angle and are at angles of 45°–45° with respect to the direction perpendicular to the record disc. However, since the yoke pieces have a shape such that they confront only approximately one half of the respective coils of the above mentioned coil plate, only one half of each coil contributes to the current inducing action and the other half does not as the coil plate vibrates together with the cantilever. Furthermore, leakage flux occurs from the edges of the yolk pieces. For this reason, in the above mentioned other half of each coil not confronting the corresponding yolk piece, there is induced a current of a direction such as to cancel the current induced in the above mentioned original magnetic flux by the leakage flux. For these reasons, there have been problems in the prior art such as low output level, occurrence of some distortion, and poor linearity.

SUMMARY OF THE INVENTION

Accordingly, it is a general object of the present invention to provide a novel and useful moving-coil type pickup cartridge in which the above described problems have been solved.

Another and specific object of the invention is to provide a moving-coil type pickup cartridge in which the coil plate is so shaped that the coils thereon are not affected by leakage flux. The coil plate is so bent that it is not disposed within the magnetic field of the leakage flux. By the use of the pickup cartridge of the present invention, currents are induced in the coils by only effective magnetic flux and are not induced by the leakage flux, whereby distortion is not produced in the output signal. Furthermore, since a large width of the magnetic field can be used, a high output can be obtained, and, moreover, the linearity of the output is good.

Still another object of the invention is to provide a moving-coil type pickup cartridge of an organization such that both halves of each coil contribute effectively to current induction. By this feature of the invention, a large output signal can be obtained.

Other objects and further features of the present invention will be apparent from the following detailed description with respect to preferred embodiments of the invention when read in conjunction with the accompanying drawings.

DETAILED DESCRIPTION

Figure 1:
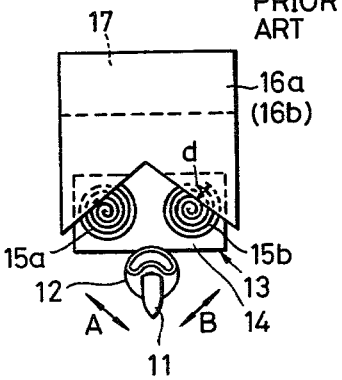
FIG. 1 PRIOR ART
FIG. 1 is a front view of one example of a pickup cartridge which we have previously proposed.

As conducive to a full understanding of the present invention, an example of a moving-coil type pickup cartridge we have previously proposed will first be described briefly with reference to FIG. 1. In this prior pickup cartridge, a coil plate 13 is fixedly mounted on a cantilever 12 holding at its free extremity a stylus 11 for tracing the groove of a record disc (not shown). This coil plate 13 comprises an electrically insulating thin base plate 14 and coils 15*a* and 15*b* formed from an electroconductive thin film, each in spirally-wound pattern, on the base plate 14. The coil plate 13 is interposed in a freely vibratory manner in a gap between a pair of yokes 16*a* and 16*b* (only the yoke 16*a* being shown in FIG. 1), which at their upper ends clamp a permanent magnet 17. The yoke 16*a* (16*b*) has a lower edge with a cutout of inverted V-shape whose V-edges are at angles of 45°–45° relative to a line plumb to the record disc, and the lower edge part of the yoke 16 creates a magnetic field of effective magnetic flux with respect to a substantially one-half, oblique upper portion of each of the coils 15*a* and 15*b*.

Then, in the space of the inverted V-shape delineated by the above mentioned lower edge, a magnetic field due to leakage flux is created, and a spurious current due to the leakage flux is induced in the oblique lower half of each of the coils 15*a* and 15*b*. The originally intended induced current due to the effective magnetic flux is cancelled by this spurious induced current, and the output decreases. Moreover, distortion is also produced. Furthermore, when the presence of leakage flux is considered, the width d of the magnetic field thus created cannot be made large, and when the coil plate vibrates with large amplitude, there arises the problem of nonlinear distortion.

The present invention solves the above described problems as will now be described with respect to a number of embodiments of the invention.

Figure 2:
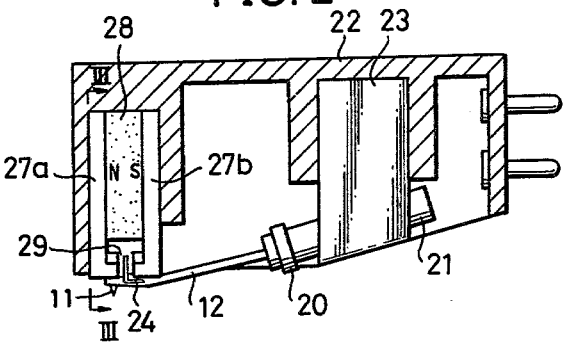
FIG. 2 is a side view, with some parts in longitudinal section, of a first embodiment of the moving-coil type pickup cartridge according to the invention.
Figure 3:
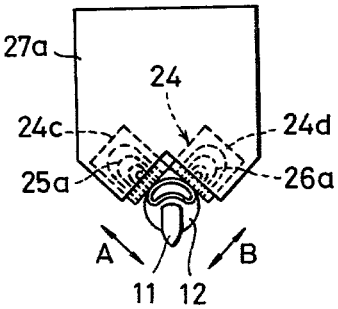
FIG. 3 is a front view taken along the line III—III in FIG. 2 as viewed in the arrow direction.
Figure 4:
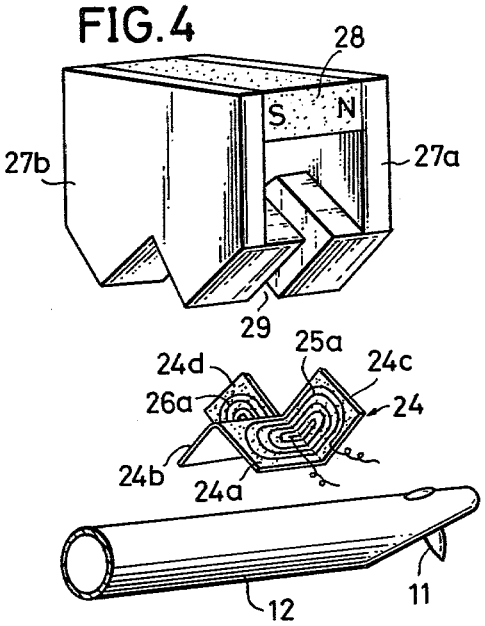
FIG. 4 is an exploded perspective view showing essential parts of the pickup cartridge illustrated in FIG. 2 as viewed obliquely from the rear.

In a first embodiment of the moving-coil type pickup cartridge according to the invention as illustrated in FIGS. 2, 3, and 4, a cantilever 12, to whose front free end a stylus 11 is fixed, is held at its rear end by way of a damper 20 by a holder 21. The holder 21 is supported by a supporting block 23 fixed to the case 22 of the pickup cartridge. A coil plate 24 is fixed in a straddling manner on the cantilever 12 at a position near the front free end thereof.

The coil plate 24 has a substantially saddle-like form comprising mounting parts 24*a* and 24*b* bent into the shape of a hillock with rounded ridge and upright parts 24*c* and 24*d* which are respectively integral with the mounting parts 24*a* and 24*b* and are bent upward substantially perpendicularly therefrom at the front end thereof. Coils 25 and 26, each of substantially elliptical spirally-wound pattern, are formed on the coil plate respectively over the mounting part 24*a* and the upright part 24*c* and over the mounting part 24*b* and the upright part 24*d*.

A pair of yokes 27*a* and 27*b* are fixed to inner parts of the case 22 near the front end thereof. Between the upper parts of these yokes 27*a* and 27*b* is clamped and held a permanent magnet 28 which has been magnetized in its thickness direction. The lower ends of the yokes 27*a* and 27*b* are formed to confront each other with a gap 29 therebetween. Within this gap 29, the upright parts 24*c* and 24*d* of the coil plate 24 are interposed in a freely vibratory manner. Also within this gap 29, a magnetic field of an effective magnetic flux induced by the permanent magnet 28 via the yokes 27*a* and 27*b* is created.

Figure 5:
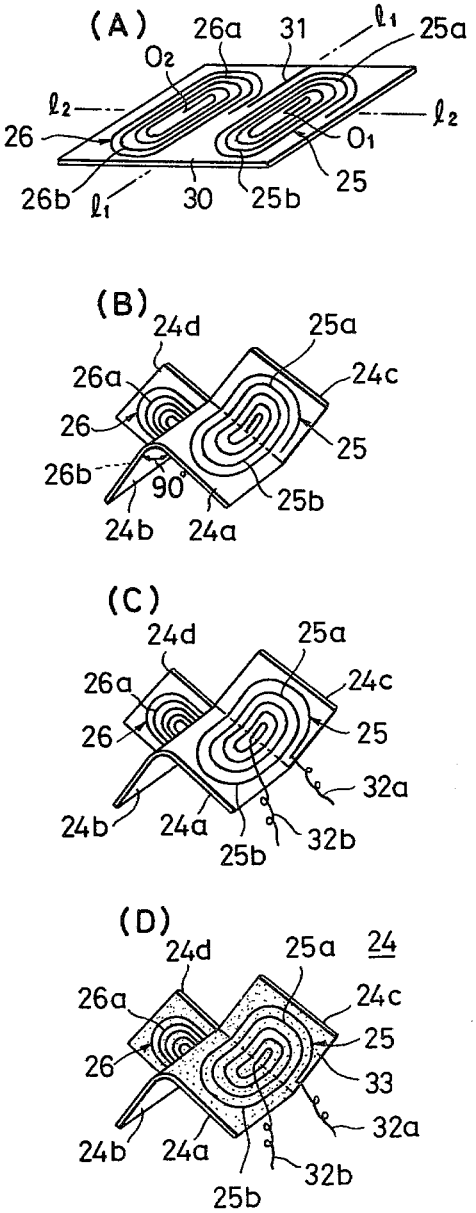
FIGS. 5(A) through 5(D) are perspective views respectively showing the coil plate of the pickup cartridge shown in FIGS. 2, 3, and 4 in progressive stages of one example of a process in the fabrication of the coil plate.

The coil plate 24 is fabricated, for example, in the following manner. First, as indicated in FIG. 5(A), thin electrically insulating substrate or base plate 30 is formed from a flexible high-polymer material. On a surface of this base plate 30, a pair of coils 25 and 26, each of elliptical, spirally-wound pattern, are formed side-by-side. These coils 25 and 26 are formed, for example, by forming by evaporation deposition a copper film on the surface of the base plate 30 and photoetching the copper film to leave the coils. On one side of this base plate 30, a line slit 31 is cut from one edge thereof to an intermediate point thereof along a line $l_1$—$l_1$ of symmetry midway between the coils 25 and 26.

Next, one half of the base plate 30, to become the upright parts 24*c* and 24*d*, is bent upward substantially at right angles along the line $l_2$—$l_2$ passing through the centers 01 and 02 of the coils 25 and 26, and, at the same time, the other half of the base plate 24, to become the mounting parts 24*a* and 24*b*, is curved along the line $l_1$—$l_1$ into the above described shape of a hillock with rounded ridge. This bending and forming step is facilitated by the existence of the above mentioned line slit. By this bending and forming step, the coil plate 24 with the hillock-shaped mounting parts 24*a* and 24*b* and the upright parts 24*c* and 24*d* bent upright therefrom as shown in FIG. 5(B) is obtained. In this connection, when the mounting parts 24*a* and 24*b* are so bent that their substantially flat parts are mutually perpendicular, the directions of the upright parts 24*c* and 24*d* bent upward from these mounting parts 24*a* and 24*b* are at angles of 45°—45° relative to a plumb line of the record disc. Half parts 25*a* and 26*a* of the coils 25 and 26 are then on the upright parts 24*c* and 24*d*, respectively, and the other half parts 25*b* and 26*b* are on the mounting parts 24*a* and 24*b*, respectively.

Next, as shown in FIG. 5(C), lead wires 32*a* and 32*b* are connected by bonding to the terminating parts of the coil 25. Similarly, lead wires are connected to the terminating parts of the coil 26 although not shown in the figure. Thereafter, as shown in FIG. 5(D), a protective film 33 is applied as a coating on the entire outer surface of the coil plate, whereupon the completed coil plate 24 is obtained. For the above mentioned electrically insulating base plate 30, materials such as aluminum foil which has been treated to coat its outer surface with an insulating film and a light-metal foil onto which a sheet of a high polymer sheet has been bonded can be used.

The coil plate 24 thus fabricated is mounted on the cantilever 12 by bonding the mounting parts 24*a* and 24*b* of the coil plate with an adhesive, for example, to the cantilever in a straddling state. Since, by this coil plate construction, the length of the mounting parts 24*a* and 24*b* thereof in contact with the cantilever 12 is long, the strength of the mounting is very much greater than that in the case where the lower edge of a coil plate of flat-plate shape is merely secured to the cantilever.

At the time when a record disc is being reproduced by the pickup cartridge, the coil plate 24 vibrates in the arrow directions A and B together with the cantilever 12 as the stylus 11 traces the sound groove of the record disc. As the coil plate 24 thus vibrates in the arrow direction A, the half coil 25*a* of the upright part 24*c* thereof traverses the effective magnetic flux between the yokes 27*a* and 27*b*, whereby a current is induced in the coil. Then, as the coil plate 24 vibrates in the arrow direction B, the half coil 26*a* of the upright part 24*d* thereof traverses the effective magnetic flux, whereby a current is induced in the coil.

At the same time, leakage flux is produced from the lower edges of the yokes 27*a* and 27*b*. However, the half coils 25*a* and 26*a* of the coil plate 24, confronting the yokes 27*a* and 27*b*, are within the effective magnetic field due to the effective magnetic flux between these yokes, and the other half coils 25*b* and 26*b* extend in a direction parallel to the longitudinal direction of the cantilever 12. For this reason, the half coils 25*b* and 26*b* do not traverse perpendicularly the leakage flux, even when the coil plate vibrates, and therefore are almost completely unaffected by the leakage flux. Accordingly, there is no cancellation of the effective current by spurious current induced by the leakage flux, whereby a large output is obtained.

Furthermore, since the width of the magnetic field in the gap 29 can be made wide, the output can be increased also by this feature. Another feature of the pickup cartridge is that, even at the time of vibration with a large amplitude, distortion is not produced in the output characteristic, and the linearity of the output signal is very good. Still another desirable feature is that, since the coil plate 24 is fixedly mounted with its mounting parts 24*a* and 24*b* facing the root end (opposite the stylus end) of the cantilever, there is only a small increase in the mechanical impedance at high frequencies as considered from the stylus tip. This feature also contributes to good frequency characteristic.

Figure 6:
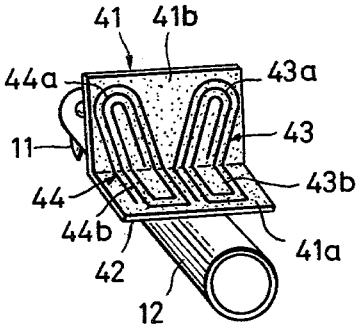
FIG. 6 is a perspective view obliquely from the rear of essential parts of a second embodiment of the moving-coil type pickup cartridge according to the invention.

The essential parts of the second embodiment of the pickup cartridge of the invention will now be described in conjunction with FIG. 6. This pickup cartridge has a coil plate 41 whose base plate 42 is formed from a single plate by bending to have a mounting part 41*a* and an upright part 41*b*, the base plate 42 being bent along a folding line perpendicular to the longitudinal centerline thereof. Over the mounting part 41*a* and the upright part 41*b* thus formed, a pair of coils 43 and 44 are formed from electroconductive film in patterns that are symmetrical with respect to the above mentioned longitudinal centerline. The half coils 43*a* and 44*a* thus formed on the upright part 41*b* are formed in directions that are at angles of 45°—45° with a vertical line. The other half coils 43*b* and 44*b* are formed on the mounting part 41*a*.

Thus, by the construction of the present embodiment of the invention, also, currents are induced by effective magnetic flux in the half coils 43*a* and 44*a*, and the other half coils 43*b* and 44*b* are not subject to the influence of leakage flux. It is to be noted that the work of bending the coil plate 42 in the present embodiment of the invention is easier than that in the preceding first embodiment of the invention.

Figure 7:
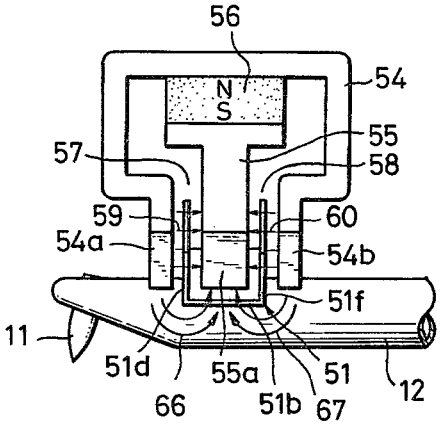
FIG. 7 is a side view of essential parts of a third embodiment of the moving-coil type pickup cartridge according to the invention.
Figure 8:
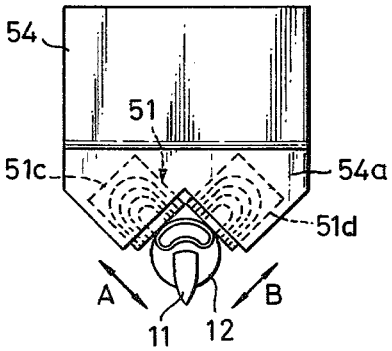
FIG. 8 is a front view of the essential parts shown in FIG. 7.
Figure 9:
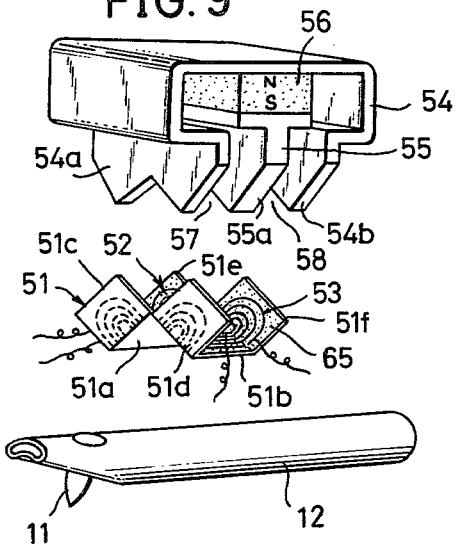
FIG. 9 is an exploded perspective view of the same essential parts.

The essential parts of the third embodiment of the pickup cartridge of the invention will now be described with reference to FIGS. 7, 8, and 9.

This pickup cartridge has a coil plate 51 which has the shape of a saddle and comprises mounting parts 51*a* and 51*b* bent into the shape of a gable roof, and upright parts 51*c* and 51*d* and upright parts 51*e* and 51*f*, which are integrally joined to the mounting parts 51*a* and 51*b* and are bent upward respectively from opposite ends of the mounting parts 51*a* and 51*b* in directions substantially perpendicular thereto. Coils 52 and 53 of substantially elliptical spirally-wound pattern are formed respectively over the mounting part 51*a* and upright parts 51*c* and 51*e* and over the mounting part 51*b* and upright parts 51*d* and 51*f*.

A yoke 54 having, in longitudinal section or in side view, a shape resembling the character C-shape with downwardly extending yoke leg parts 54*a* and 54*b*, which confront each other with a specific gap therebetween, is disposed above the cantilever 12. A yoke 55 having, in longitudinal section or side view, a T-shape is interposed between the yoke leg parts 54*a* and 54*b*. Between the top of this T-shaped yoke 55 and the inner wall surface of the yoke 54 at the middle part thereof, a permanent magnet 56 magnetized in its thickness direction is clamped and held. The leg part 55*a* of the yoke 55 is interposed at the center of the gap between the leg parts 54*a* and 54*b* of the yoke 54, gaps 57 and 58 thereby being formed respectively between the leg parts 54*a* and 55*a* and between the leg parts 54*b* and 55*a*. The aforedescribed upright parts 51*c* and 51*d* and upright parts 51*e* and 51*f* of the coil plate 51 are interposed in a freely vibratory state within these gaps 57 and 58, respectively.

In the case where the magnetic poles N and S of the magnet 56 are in contact with the yokes 54 and 55, respectively, an effective magnetic flux 59 from the leg part 54*a* toward the leg part 55*a* is produced in the gap 57, and an effective magnetic flux 60 in the direction opposite to that of the magnetic flux 59 from the leg part 54*b* toward the leg part 55*a* is produced in the gap 58.

Figure 10:
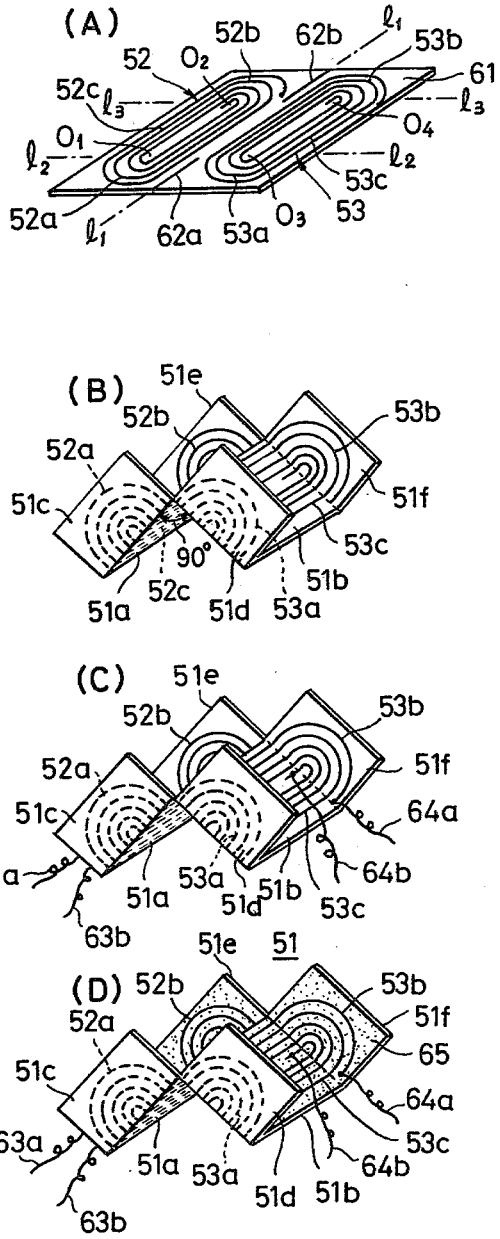
FIGS. 10(A) through 10(D) are perspective views respectively showing the coil plate of the pickup cartridge shown in FIGS. 7, 8, and 9 in progressive stages of one example of a process in the fabrication of the coil plate.

The above described coil plate 51 is fabricated, for example, in the following manner. First, as shown in FIG. 10(A), a thin electrically insulating base plate 61 is formed from a flexible high-polymer material. Then, on a surface of this base plate 61, the coils 52 and 53 are formed in an elliptical spirally-wound pattern from a thin electroconductive film. Line slits 62*a* and 62*b* of specific lengths are cut respectively on opposite sides of the base plate 61 along the line of symmetry $l_1$—$l_1$ midway between the coils 52 and 53.

Next, the opposite end parts of the base plate 61 are respectively bent substantially through 90 degrees of angle along a fold line $l_2$—$l_2$ passing through the centers 01 and 03 of the semicircular arcuate parts 52*a* and 53*a* of the coils 52 and 53 and along a fold line $l_3$—$l_3$ passing through centers 02 and 04 of the opposite semicircular arcuate parts 52*b* and 53*b* of the coils. At the same time, the portion of the base plate 61 between the lines $l_2$—$l_2$ and $l_3$—$l_3$ is bent into the shape of a gable roof along the line $l_1$—$l_1$ to form the mounting parts 51*a* and 51*b*. As a result of this bending process step, the base plate 61 is formed to have the mounting parts 51*a* and 51*b* bent into the shape of the gable roof and flange-like upright parts 51*c*, 51*e*, 51*d*, and 51*f* bent upright from the mounting parts 51*a* and 51*b* as shown in FIG. 10(B). The semicircular arcuate end parts 52*a* and 52*b* of the coil 52 and the semicircular arcuate end parts 53*a* and 53*b* of the coil 53 are respectively disposed on the upright parts 51*c* and 51*e* and the upright parts 51*d* and 51*f*, and the remaining middle parts 52*c* and 53*c* of the coils are disposed on the mounting parts 51*a* and 51*b*. Next, as shown in FIG. 10(C), lead wires 63*a*, 63*b*, 64*a*, and 64*b* are connected by bonding to the terminal ends of the coils 52 and 53. Thereafter, as shown in FIG. 10(D), a protective film 65 is applied as a coating over the entire outer surface of the coil plate, whereupon the completed coil plate 51 is obtained. This coil plate 51 is fixedly mounted on the cantilever 12 so that its mounting parts 51*a* and 51*b* are straddling the cantilever 12.

At the time when a record disc is being played by the use of the pickup cartridge, the coil portions 52*a* and 52*b* of the upright parts 51*c* and 51*e* traverse the effective magnetic fluxes 59 and 60 in the gaps 57 and 58 as the coil plate 51 vibrates in the arrow direction A, whereby currents are induced in these coil portions. While the winding directions as viewed in front view of the coil portions 52*a* and 52*b* are opposite in this case, since the magneic fluxes 59 and 60 are also of opposite directions, the currents induced in the coil portions 52*a* and 52*b* are mutually added. Consequently, an output which is higher than that in the preceding first embodiment of the invention wherein a single upright part is used is obtained between the lead wires 63*a* and 63*b*. Similarly, as the coil plate 51 vibrates in the arrow direction B, currents are induced in the coil portions 53*a* and 53*b* of the upright parts 51*d* and 51*f*, whereby a high output is similarly obtained.

Although leakage fluxes 66 and 67 are generated from the lower edges of the yoke leg parts 54*a* and 54*b* in this case, the coil portions 52*a*, 52*b*, 53*a*, and 53*b* of the coils 52 and 53 are within effective magnetic fields, and the middle portions 52*c* and 53*c* are also at positions where they are not subject to the influence of the leakage flux. For this reason, currents are not induced by leakage flux in the coils 52 and 53. Therefore, conjointly with result of each coil having two power generating coil portions, a large output is obtained.

Figure 11:
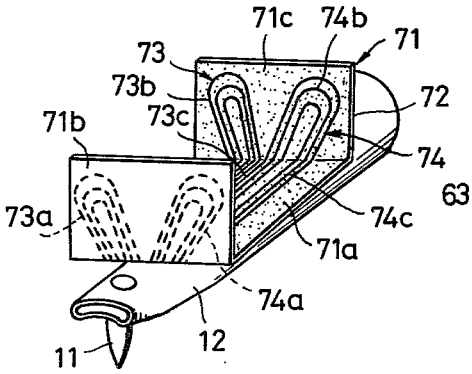
FIG. 11 is a perspective view of essential parts of a fourth embodiment of the moving-coil type pickup cartridge according to the invention.

The essential parts of a fourth embodiment of the pickup cartridge of the present invention will now be described in conjunction with FIG. 11. The coil plate 71 in this pickup cartridge is formed by bending upward the opposite ends of a base plate 72 to form a middle mounting part 71*a* and upright parts 71*b* and 71*c*. Over these mounting part 71*a* and upright parts 71*b* and 71*c*, a pair of coils 73 and 74 are formed. Coil portions 73*a*, 73*b*, 74*a*, and 74*b* on the upright parts 71*b* and 71*c* are formed respectively in directions at 45°—45° relative to the vertical direction. The other portions 73*c* and 74*c* of these coils are disposed on the mounting part 71*a*.

That a high performance can be obtained from the pickup cartridge of the present embodiment of the invention will be readily understood from the preceding second and third embodiments of the invention, and, therefore, repetitive description thereof will be omitted.

Further, this invention is not limited to these embodiments but various variations and modifications may be made without departing from the scope of the invention.

What is claimed is:

1. A moving-coil type pickup cartridge comprising: a cantilever provided at the free end thereof with a stylus for tracing a sound groove of a record disc; a single coil plate provided on the cantilever in a manner to vibrate in response to vibration of the stylus; and means for producing an effective magnetic field within a specific gap, said coil plate comprising a thin electrically insulating base plate and a pair of coils which are symmetrically disposed on opposite sides of a centerline on at least one surface of the base plate and being formed of a thin film in a spirally-shaped pattern on at least one surface of the base plate, and having at least one upright bent part defined by bending the base plate together with a portion of each of the coils and being interposed in a freely vibratory manner within said gap of the magnetic field producing means and a mounting part integrally joined to the upright bent part and fixed to the cantilever.

2. A moving-coil type pickup cartridge as claimed in claim 1 wherein: the coil plate has a pair of upright bent parts defined by bending the base plate at one end thereof together with one end portion of the coils, and having the mounting part bent along the centerline into a shape resembling a gable roof and being further mounted in a straddling manner on and fixed to the cantilever along the longitudinal direction thereof.

3. A moving-coil type pickup cartridge as claimed in claim 1 wherein: the coil plate has an upright bent part formed by bending the base plate at one end thereof together with one end portion of the coils along a line perpendicular to said centerline.

4. A moving-coil type pickup cartridge as claimed in claim 1, wherein: the coil plate has two pairs of upright bent parts formed by bending the base plate at both ends thereof together with both end portions of the coils, and having the mounting part bent along the centerline into a shape resembling a gable roof and being mounted in a straddling manner on and fixed to the cantilever along the longitudinal direction thereof.

5. A moving-coil type pickup cartridge as claimed in claim 4, wherein: the magnetic field producing means has two pairs of gaps of specific width and pairs of upright bent parts of the coil plate being interposed to produce effective magnetic fields of effective magnetic fluxes of mutually opposite directions respectively in the gaps.

6. A moving-coil type pickup cartridge as claimed in claim 1, wherein: the coil plate has two upright bent parts formed by bending the base plate at both ends thereof together with both ends portions of the coils along a line perpendicular to said centerline.

* * * * *